United States Patent [19]

Johnston

[11] Patent Number: 4,616,704

[45] Date of Patent: Oct. 14, 1986

[54] CONTROL LINE PROTECTOR FOR USE ON A WELL TUBULAR MEMBER

[75] Inventor: Russell A. Johnston, Houston, Tex.

[73] Assignee: Camco, Incorporated, Houston, Tex.

[21] Appl. No.: 759,384

[22] Filed: Jul. 26, 1985

[51] Int. Cl.[4] ..... E21B 17/14

[52] U.S. Cl. ..... 166/242; 166/117.5

[58] Field of Search ..... 166/242, 117.5, 65.1, 166/382, 350, 359, 367; 138/110-113; 174/47; 175/320

[56] References Cited

U.S. PATENT DOCUMENTS

| | | | |
|---|---|---|---|
| 3,844,345 | 10/1974 | Evoms et al. | 166/242 X |
| 4,388,969 | 6/1983 | Marshall et al. | 166/242 X |
| 4,541,482 | 9/1985 | Johnston | 166/242 X |

FOREIGN PATENT DOCUMENTS

| | | | |
|---|---|---|---|
| 2121091 | 12/1983 | United Kingdom | 166/242 |

*Primary Examiner*—Stephen J. Novosad
*Assistant Examiner*—Thuy M. Bui
*Attorney, Agent, or Firm*—Fulbright & Jaworski

[57] ABSTRACT

First and second members each having a first side shape for coacting with and secured longitudinally to the outside of a tubular member in a parallel spaced relationship for enclosing a portion of a well control line. Each of the members has tapered ends for avoiding catching on shoulders in a well. Each of the members has a longitudinal groove on the inside extending the length of the member and a plate is inserted in the grooves for enclosing a control line between the plate and the outside of the tubular member. An opening is provided in each of the members extending from the outside of the member through the groove for allowing the deformation of the plate for securing the plate in the grooves. The outside of the members are rounded for fitting into an outer tubular member.

10 Claims, 3 Drawing Figures

CONTROL LINE PROTECTOR FOR USE ON A WELL TUBULAR MEMBER

BACKGROUND OF THE INVENTION

It is well known in an oil and/or gas well to provide various types of control lines, such as electrical or hydraulic control lines, to extend down the outside of the well tubing to control various types of well equipment such as safety valves. However, it is important that the control lines be protected from damage as the well tubing is lowered into the well so as to prevent the control lines from being caught or jammed between the well tubing and the well such as the well casing. At the present time, the control lines are generally strapped to the tubing which has proved somewhat less than satisfactory. For example, some well equipment, such as sidepocket mandrels, which are oval in shape have little or no clearance between its long horizontal diameter and an enclosed casing. Therefore, the control lines must be placed on the flat side of the oval in order to avoid pinching the control lines.

The present invention is directed to a control line protector which can be connected to the side of the tubing or tubing equipment such as a sidepocket mandrel to provide protection for the control lines by insuring their proper alignment with the tubing for maximum protection.

SUMMARY

The present invention is directed to a control line protector for use on a well tubular member and includes first and second members having a first side for attachment to the outside of the tubular member in a spaced parallel relationship for enclosing a portion of a well control line. Each of the members have ends which are tapered inwardly for avoiding catching on shoulders in a well. Each of the members includes a longitudinal groove on the inside for receiving a plate in the grooves for enclosing the control line between the plate and the outside of the tubular member. Means are provided on each of the members for securing the plate in the grooves and to said members.

Yet a still further object of the present invention is the provision of an opening in each of the members extending from the outside of the member through the groove for allowing the deformation of the plate for securing the plate in the grooves.

Still a further object of the present invention is wherein the grooves extend the length of the members and are mirror images of each other for simplication of manufacture. Furthermore, the length of the plate is no greater than the length of the grooves whereby the plate will not extend beyond the ends of the members when secured in the grooves.

Still a further object of the present invention is wherein the outside of the members are rounded for fitting into an outer tubular member such as a casing.

Still a further object of the present invention is the provision of a sidepocket mandrel having a control line protector in which the sidepocket mandrel has a body which is oval in cross section. First and second members are longitudinally secured on the outside of one of the flat sides of the oval body and the members are spaced from each other and positioned parallel to each other. Each of the members includes ends which are tapered inwardly for avoiding catching on shoulders in the well. Each of the members has a longitudinal groove on the inside which extends the length of the member and a plate is positioned in the groove for enclosing a control line between the plate and the outside of the mandrel. Means are provided on each member for securing the plate in the grooves and to said members.

Other and further objects, features and advantages will be apparent from the following description of a presently preferred embodiment of the invention, given for the purpose of disclosure and taken into conjunction with the accompanying drawings.

DESCRIPTION OF THE PREFERRED EMBODIMENT

While the present invention will be described in connection with a control line protector for use on a sidepocket mandrel for purposes of illustration only, the present invention can be used on various other types of well tubular members or pipes to provide protection for control lines used in an oil and/or gas well.

Figure 1:
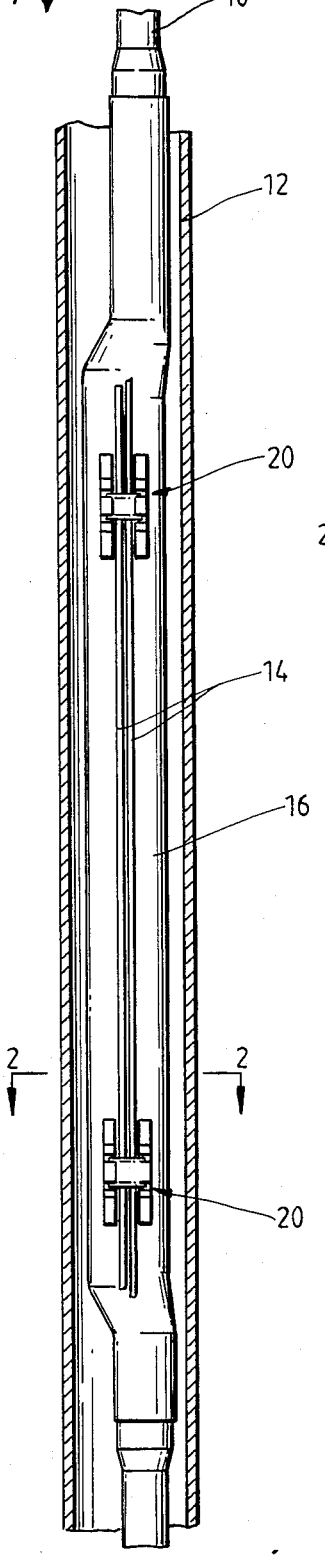
FIG. 1 is an elevational view showing the present invention in place on a sidepocket mandrel in a well.
Figure 2:
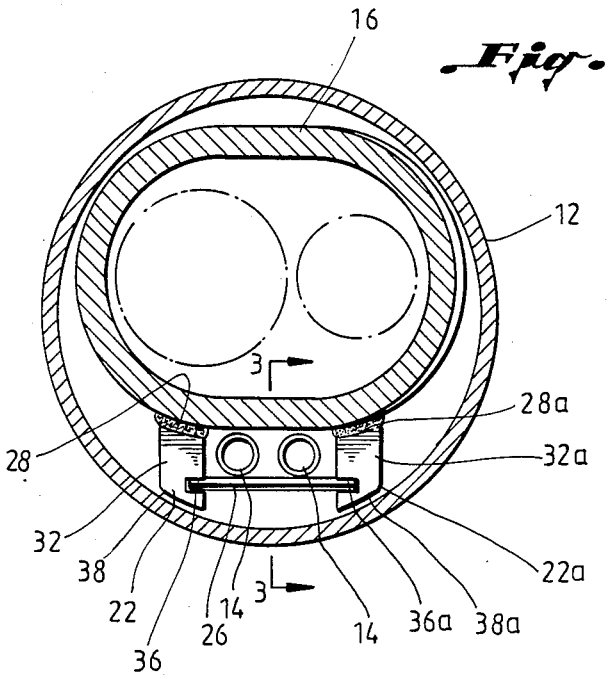
FIG. 2 is an enlarged cross-sectional view taken along the line 2—2 of FIG. 1.

Referring now to the drawings, particularly to FIG. 1, a well tubing generally indicated by the reference numeral 10 is provided extending into an oil and/or gas well through a casing 12. Various types of controlled equipment may be provided connected to the tubing 10 such as safety valves (not shown) which are actuated and/or controlled from the well surface by one or more control lines 14. The control lines may take various forms such as electrical lines, hydraulic lines, individual lines, capsulated lines and thus may take various forms. However, the control lines 14 extend into the well on the exterior of the well tubing 10 and any tools connected therein and inside of the casing 12. The control lines 14 are inserted into the well along with the tubing 10 and care must be taken to insure that they are not damaged, pinched or broken as the tubing 10 is inserted into the casing 12. This requires considerable care as the control lines 14 may extend several thousand feet into a well. Furthermore, some types of well equipment such as a typical sidepocket mandrel such as the type KBMG sold by Camco, Incorporated, utilizes a oval shaped body. As shown in FIG. 2, the oval shape body of the mandrel 16 frequently has close tolerances with the inside of the well casing 12, particularly on the long horizontal axis of the oval body of the mandrel 16.

The present invention is directed to providing a control line protector generally indicated by the reference numeral 20 for use on a well tubular member such as a mandrel 16, which will protect, guide, and secure the control lines 14 in their proper place. The protector 20 generally includes first and second members 22 and **22*a* and a covering plate 26**.

The members 22 and **22*a* have a first side 28 and 28*a*, respectively, which may be contoured, if desired, to coact with the surface of the well tool 16 and is secured to the exterior of the well tool 16 such as by welding. The first and second members 22 and 22*a* are longitudinally secured to the outside of the well member 16 and spaced from each other, but are parallel to each other for enclosing a portion of the well control line 14. Each of the members 22 and 22***a* have ends 32 and 32*a* which are tapered inwardly to the member 16 so that the members 22 and 22*a* may be moved down the hole in the casing 12 without catching on shoulders in the casing 12 or in the well. Each of the members 22 and 22*a* includes a longitudinal groove 36 and 36*a*, respectively, on the inside. And each of the members 22 and 22*a* includes a rounded outer surface 38 and 38*a*, respectively, whereby the members 22 and 22*a* may more easily fit into an outer tubular member such as the casing 12. It is to be noted that members 22 and 22*a* are thus mirror images of each other which simplifies the manufacturing and reduces the cost.

A plate 26 is adapted to be inserted into the grooves 36 and 36*a* for enclosing the control line or lines 14 between the plate 26 and the outside of the tubular member 16. It is to be noted that the plate 26 has a length no greater than the length of the grooves 36 and 36*a* so as not to protrude and catch on shoulders in the well. Preferably, the plate 26 is flat, although it could have other shapes such as protruding outwardly with a rounded outwardly recessed surface to accommodate large diameter control lines.

Figure 3:
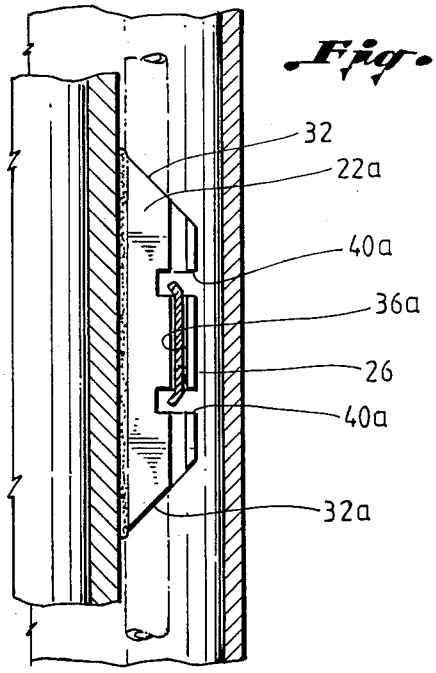
FIG. 3 is a cross-sectional view taken along the line 3—3 of FIG. 2.

Means are provided on each of the members 22 and 22*a* for securing the plate 26 in the grooves 36 and 36*a*. Such means may include one or more openings 40 and 40*a* which extend from the outside of each member through the grooves for allowing the deformation, as best seen in FIG. 3, for securing the plate 26 in the grooves 36 and 36*a*. Other types of securing means such as pins or set screws could be used.

In use, the members 22 and 22*a* are welded onto the exterior of the sidepocket mandrel 16. When running the mandrel in the well, the control lines 14 are inserted between the members 22 and 22*a*, the plate 26 is inserted and manually deformed through the openings 40 and 40*a* to bend the edges down and keep the plate in position in the grooves 36 and 36*a*. The control line 14 is now secured and protected by the members 22 and 22*a* and the plate 26. In the event that it is desirable to remove the plate 26, a tool may be inserted into the bottom of the openings 40 and 40*a*, such as a screwdriver, to pry up the deformation so that the plate 26 can be driven out of the grooves 36 and 36*a*.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will be readily apparent to those skilled in the art and which are emcompassed within the spirit of the invention and the scope of the appended claims.

What is claimed is:

1. A control line protector for use on a well tubular member comprising, first and second members having a first side for attachment to the outside of the tubular member in a parallel spaced relationship for enclosing a portion of a well control line, each of said members having ends which are tapered inwardly for avoiding catching on any shoulders in a well, each of said members having a longitudinal groove on the inside, a plate adapted to be inserted in said grooves for enclosing a control line between the plate and the outside of the tubular member, and means on each of the members for securing the plate in the grooves and to said members.

2. The apparatus of claim 1 wherein the securing means includes, an opening in each of the members extending from the outside of the member through the groove for allowing the deformation of the plate for securing the plate in the grooves.

3. The apparatus of claim 1 wherein said grooves extend the length of said members.

4. The apparatus of claim 1 wherein the outside of said members are rounded for fitting into an outer tubular member.

5. The apparatus of claim 1 wherein the outside of said members are rounded for fitting into an outer tubular member.

6. A control line protector for use on a well tubular member comprising, first and second members each having a first side shaped for coacting with and secured to the outside of said tubular member in a parallel spaced relationship for enclosing a portion of a well control line, each of said members having ends which are tapered inwardly for avoiding catching on any shoulders in a well, each of said members having a longitudinal groove on the inside extending the length of the members, a plate inserted in said grooves for enclosing a control line between the plate and the outside of the tubular member, the length of the plate being no greater than the length of said grooves, and an opening in each of the members extending from the outside of the member through the groove for allowing the deformation of the plate for securing the plate in the grooves.

7. A sidepocket mandrel having a control line protector comprising, a side pocket mandrel having a body which is oval in cross section, first and second members longitudinally secured on the outside of the one of the flat sides of the oval body, said members spaced from each other and positioned parallel to each other, each of said members having ends which are tapered inwardly for avoiding catching on any shoulders in a well, each of said members having a longitudinal groove on the inside, a plate positioned in said grooves for enclosing a control line between the plate and the outside of the mandrel, and means on each of the members for securing the plate in the grooves and to said members.

8. The apparatus of claim 7 wherein the securing means includes, an opening in each of the members extending from the outside of the member through the groove for allowing the deformation of the plate for securing the plate in the grooves.

9. The apparatus of claim 7 wherein said grooves extend the length of said members and the length of the plate is no greater than the length of said grooves.

10. The apparatus of claim 7 wherein the outside of said members are rounded for fitting into an outer tubular member.

* * * * *